US005555751A

United States Patent [19]

Strickland et al.

[11] Patent Number: 5,555,751

[45] Date of Patent: Sep. 17, 1996

[54] SEMIAUTOMATIC OPERATED HANDCUFFS WITH PIVOTAL ARCUATE BLADES

[76] Inventors: Frederick W. Strickland, 1520 Blueberry Dr., Titusville, Fla. 32780; Joseph L. Bastarache, Rte. 1 Box 396, Blowing Rock, N.C. 28605

[21] Appl. No.: 331,917

[22] Filed: Oct. 31, 1994

[51] Int. Cl.[6] ..... E05B 75/00

[52] U.S. Cl. ..... 70/16

[58] Field of Search ..... 70/15–17, 19

[56] References Cited

U.S. PATENT DOCUMENTS

| | | | |
|---|---|---|---|
| 636,439 | 11/1899 | Maltby | 70/17 |
| 691,941 | 1/1902 | Headson | 70/17 |
| 1,116,329 | 11/1914 | Russell | 70/16 |
| 1,579,333 | 4/1926 | Neal | 70/16 |
| 2,516,878 | 8/1950 | Howe | 70/16 |
| 3,545,237 | 12/1970 | Thompson et al. | 70/16 |
| 4,138,867 | 2/1979 | Tompkins | 70/16 |
| 4,314,466 | 2/1982 | Harris | 70/16 |
| 4,972,784 | 11/1990 | Ing-Hsiang | 70/16 X |
| 5,007,257 | 4/1991 | Thompson | 70/16 |
| 5,138,852 | 8/1992 | Corcoran | 70/16 |
| 5,205,142 | 4/1993 | Kruger et al. | 70/16 |

FOREIGN PATENT DOCUMENTS

| | | | |
|---|---|---|---|
| 829746 | 7/1938 | France | 70/17 |
| 248229 | 6/1912 | Germany | 70/17 |
| 53042 | 9/1933 | Norway | 70/17 |
| 145653 | 5/1931 | Switzerland | 70/17 |
| 275666 | 11/1927 | United Kingdom | 70/17 |

*Primary Examiner*—Lloyd A. Gall

[57] ABSTRACT

Disclosed is a handcuff with a set of arcuate blades that are pivotally mounted at opposite ends of a single rectangular box-like casing. A set of telescoping handles, for slidable movement, is supported by a set of internally mounted cam assemblies. The cam assembly has concave cam surfaces. As the rectangular box-like casing bumper makes contact against the suspect's wrist, the officer will apply a forward movement of the telescoping handles. This forward movement of the handle and cam assembly causes the cam's concave surfaces to engage with the pivotal blade rollers. This will cam the blade rollers and rotates the first arcuate blade in a clockwise direction and the second blade in a counter clockwise direction encircling the suspect's wrist. To open the arcuate blades, one would insert and rotate a key to release the cam locking assembly. Unlocking it will simultaneously allow the cam spring to automatically retract the handcuff's handles and the arcuate blades' springs to rotate the arcuate blades to the open and ready-to-use position.

8 Claims, 5 Drawing Sheets

SEMIAUTOMATIC OPERATED HANDCUFFS WITH PIVOTAL ARCUATE BLADES

BACKGROUND—FIELD OF INVENTION

The present invention is directed at improvements in handcuffs and more particularly to arrangements providing for mechanical closing and automatic opening of the pivotal arcuate blades.

BACKGROUND—DESCRIPTION OF PRIOR ARTS

Handcuffs used by police and law enforcement officers for prisoner restraint worldwide are basically standardized in construction and operation. Typically, the handcuffs are comprised of a pair of wristlets either hinged, connected, or more frequently joined together by short chain links.

When applying handcuffs, the officer is often standing relatively close to the suspect. This puts the officer in physical danger if the suspect is violent or is struggling. The handcuffs are applied to one wrist at a time, requiring the officer to use one hand to rotate the ratchet blade through the locking means and the other hand to restrain the violent or struggling suspect.

If the blades are closed prematurely, either inadvertently by the officer or intentionally by the suspect, the blade of some handcuffs can be locked against movement, either forward or rearward; thus the handcuffs are effectively rendered useless until the officer can locate the proper key and return the handcuffs to their ready condition. Most other handcuffs may require the officer to rotate the blade 360° degrees to the ready position. This frequently places the arresting officers in dangerous and even life-threatening situations because of the extra time it takes to reset the handcuffs to the ready-to-use position.

Efforts have been made to improve the safety aspects of conventional handcuffs. For example, U.S. Pat. No. 5007257 to Thompson (1991), U.S. Pat. No. 5205142 to Kruger (1993) and U.S. Pat. No. 4840048 to Elam (1989) show a shield or hinge assembly applied to the wristlets to rigidify the connection between the prisoner's wrists. No improvements were applied to the conventional ratchet blades. The officer must rotate the ratchet blade manually to restrain the prisoner. U.S. Pat. No. 4314466 to Harris (1982) indicates that handcuffs used by police and law enforcement officers for prisoner restraint worldwide are basically standardized in construction and operation, in that the flexible connection chains of the first and second wristlets offer no rigidity or leverage to the officer. U.S. Pat. No. 3545237 to Thompson (1968) describes a restraining device that retains the wrists of a person without direct manual assistance. An electric-driven motor and gears are used to close the restraining blades and encircle the suspect's wrist. To release the wrists the officer would push a hand operated open control button. This device is anchored to a stationary object, such as in a correctional facility holding room or to the outside or inside of a vehicle. This type of restraining device has very limited use to the officer working alone and trying to subdue a suspect. The officer must capture the suspect, move the un-handcuffed suspect to the stationary mounted restraining device, then press a button to activate and close the blades. This type of device places the arresting officer in dangerous and even life-threatening situations with a violent or struggling suspect.

OBJECTIVES AND ADVANTAGES OF THE PRESENT INVENTION

It is the primary objective of the present invention to provide a novel and improved pair of handcuffs with a mechanical closing means. More particularly, there is a set of telescoping handles installed over a single rectangular box-like casing and supported for movement by a set of internal mounted cam assemblies; in combination with a set of blade roller assemblies, are used to mechanically close the arcuate blades. The mechanical features of the telescoping handles and the cam assemblies of the present invention eliminate the manual closing requirements of the previously described handcuffs and offers a positive closing force applied to the arcuate blades.

A second objective of this invention is to eliminate the flexibility between the first and second handcuff members, which will substantially reduce the prisoner's ability to manipulate his hands and restrict his freedom of movement. This will also allow the rigid structure of the handcuffs to be used as leverage to help subdue a suspect and can be used as a defensive weapon when required to help protect the officer's life under extreme conditions.

Another objective of the present invention is to provide a rigid structure that forms a rectangular box-like casing, housing the pivotally arcuate blades and providing a cam assembly to mechanically operate the arcuate blades.

A further objective of the present invention is to provide a ready-to-use set of handcuffs whereby the arcuate blades are always in the spring loaded open position. This will eliminate the requirement for the arresting officer to manually rotate the arcuate blade to the open position while attempting to restrain the suspect.

Still another objective of this invention is to provide a pair of handcuffs that operate in a familiar manner for those who are accustomed to operating conventional handcuffs with only one exception: applying enough pressure to slide the telescoping handle and cam assembly toward the suspect's limb, forcing the arcuate blades to mechanically close.

Additional objectives and advantages of the present invention are set forth in part by the description that follows, and in part it will be obvious from the implementation and direct use of this invention. The objectives and advantages may be realized and attained by means of the instrumental and combinations particularly specified in the appended claims.

To achieve the following, and other objectives and advantages, and in accordance with the purposes of the present invention as embodied and broadly described herein, handcuffs constructed in accordance with the present invention may be comprised of a primary and secondary arcuate blade pivotally mounted to the casing by means of pivotal support studs that allow arcuate blades freedom of movement in a clockwise and counter-clockwise direction. In operation, the handcuff casing bumper will communicate with the suspect's wrist, which will effectively restrict the forward movement of the handcuff casing. The telescoping handcuff handle (being held by the officer) will be pushed forward, overcoming the cam assembly spring tension and moving the cam assembly forward, applying sufficient force against the arcuate blade rollers. This force, applied to the rollers, will cause the rollers to roll within the concave surface of the cam and rotate or swing the first blade counter-clockwise and the second blade clockwise in a rapid movement around the wrist of the suspect, automatically locking the blades by means of a cam locking assembly.

The accompanying drawings that are incorporated in and constitute a part of this specification illustrate the embodiments of the present invention; together with the description, they serve to explain the principles of the invention. Like numerals are employed to designate like parts throughout.

DESCRIPTION OF A PREFERRED EMBODIMENT

Figure 1:
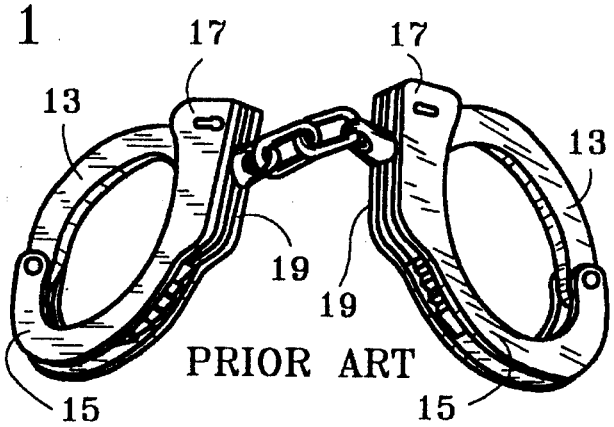
FIG. 1 Is a perspective view of a joined and matching pair of prior art handcuffs.
Figure 2:
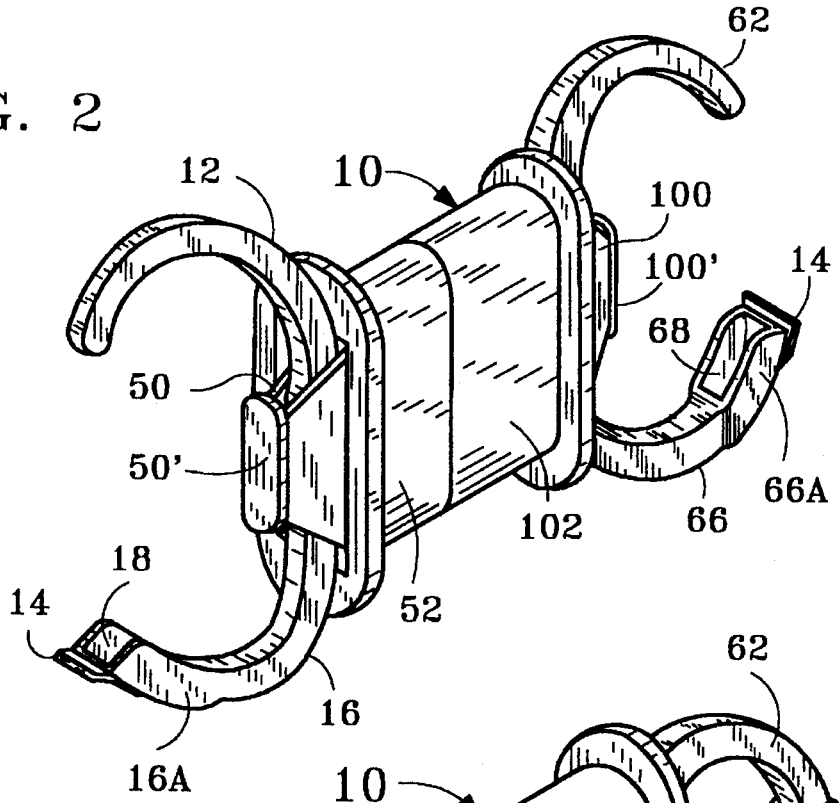
FIG. 2 Is a perspective view of the mechanically operated handcuff assembly of the present invention showing the open arcuate blades and telescoping handles.
Figure 3:
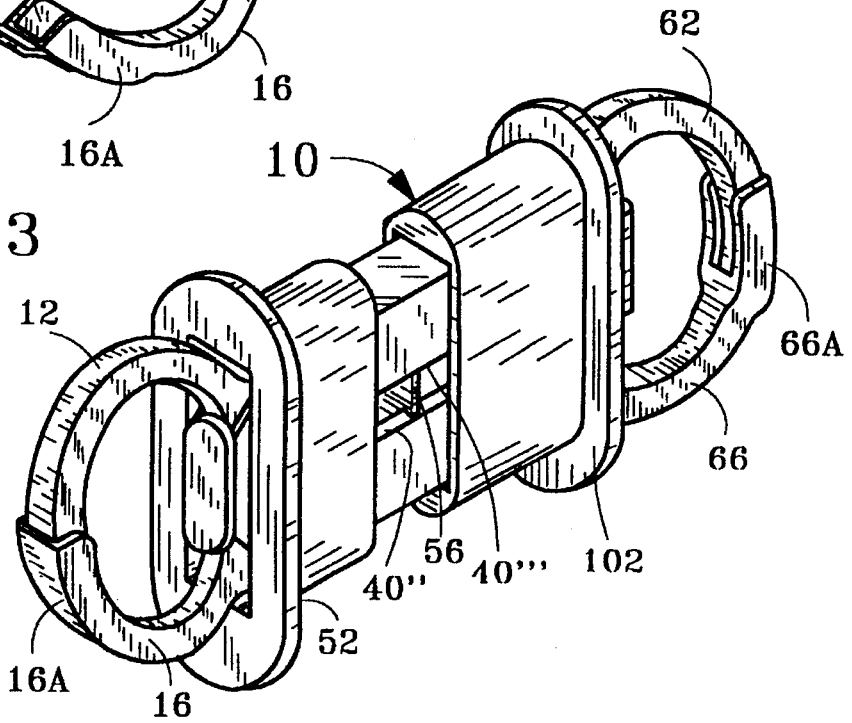
FIG. 3 Is a perspective view of the mechanically operated handcuff assembly of the present invention showing the closed arcuate blades assembly and telescoping handles.
Figure 4:
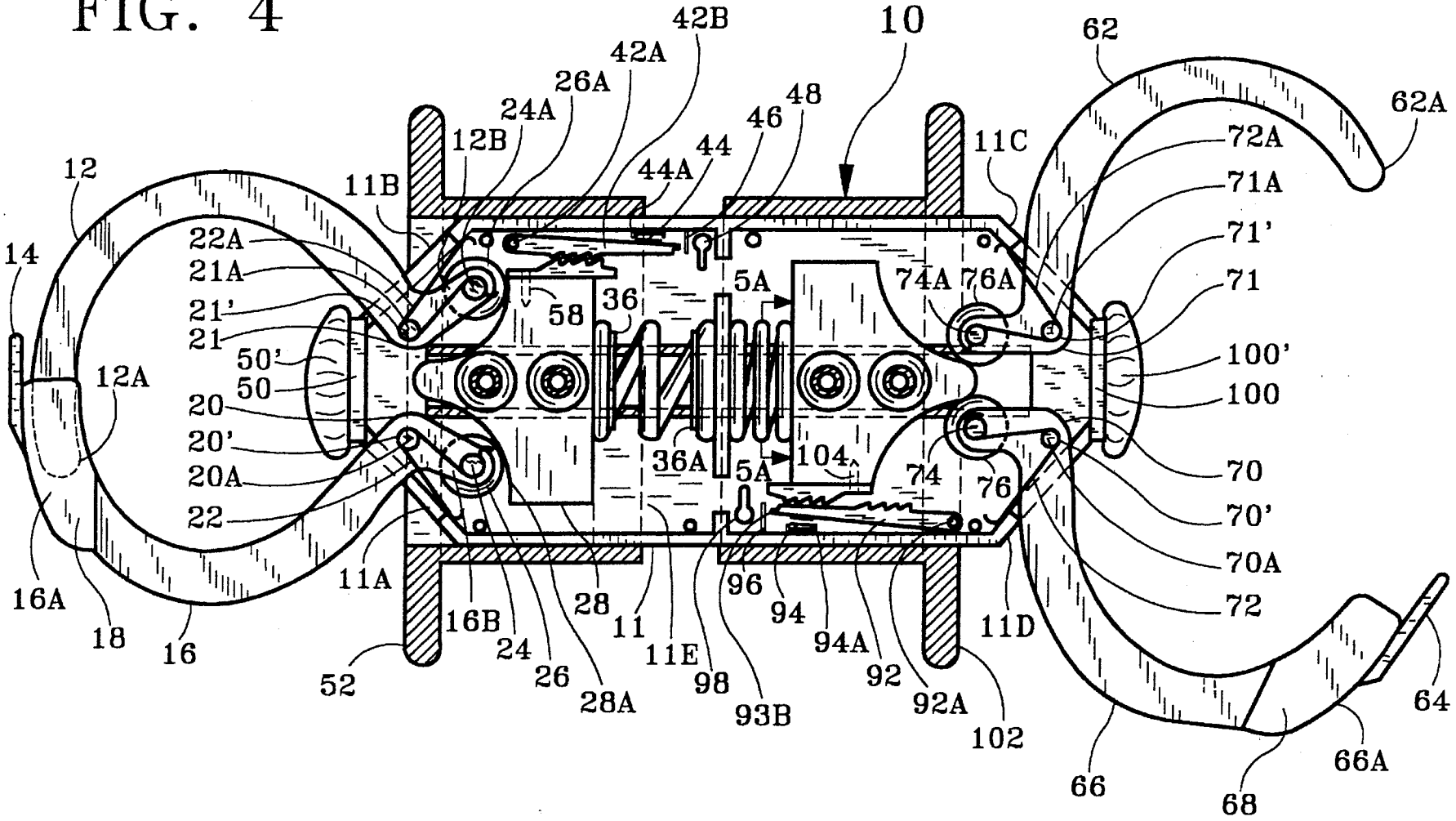
FIG. 4 Is an elevational view showing the mechanically operated handcuffs.
Figure 5:
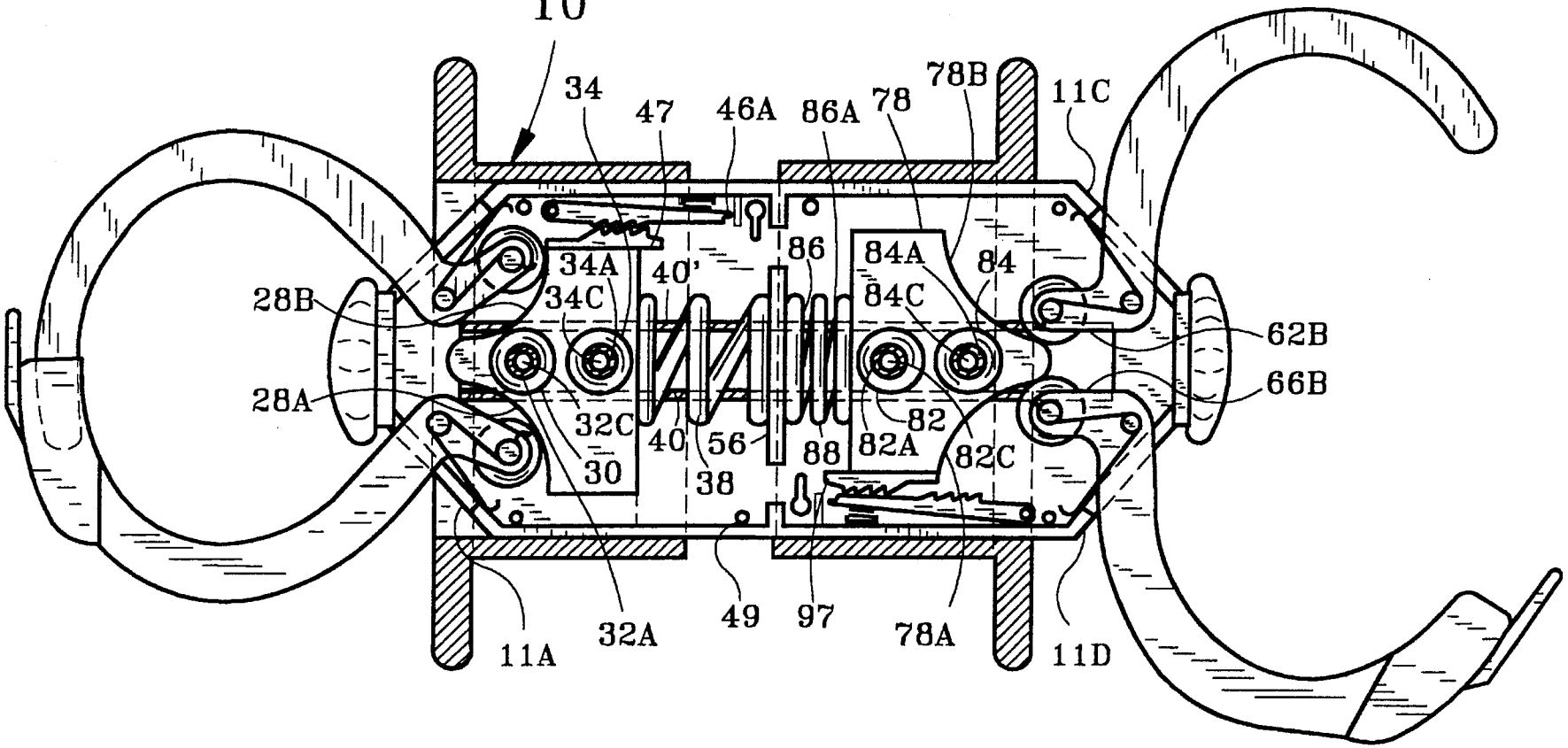
FIG. 5 Is an enlarged elevational view showing the telescoping handles, bumpers, rectangular box-like casing, arcuate blades, blade springs, blade rollers, support studs, cams, cam rollers, cam springs, cam lock assemblies and a detail view of the rectangular extruded flanges of the mechanically operated handcuffs.
Figure 5A:
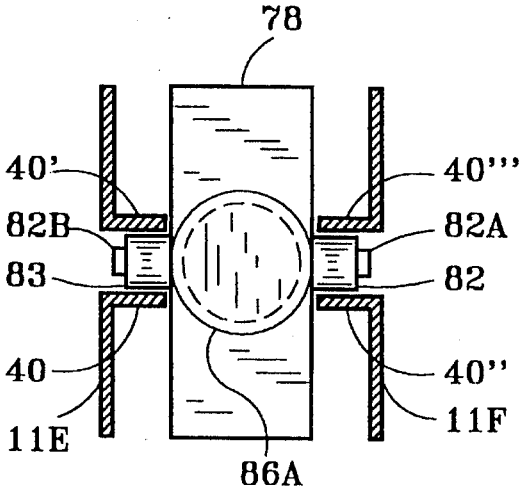
FIG. 5*a* is a cross-sectional view illustrating the extruded flanges.
Figure 6:
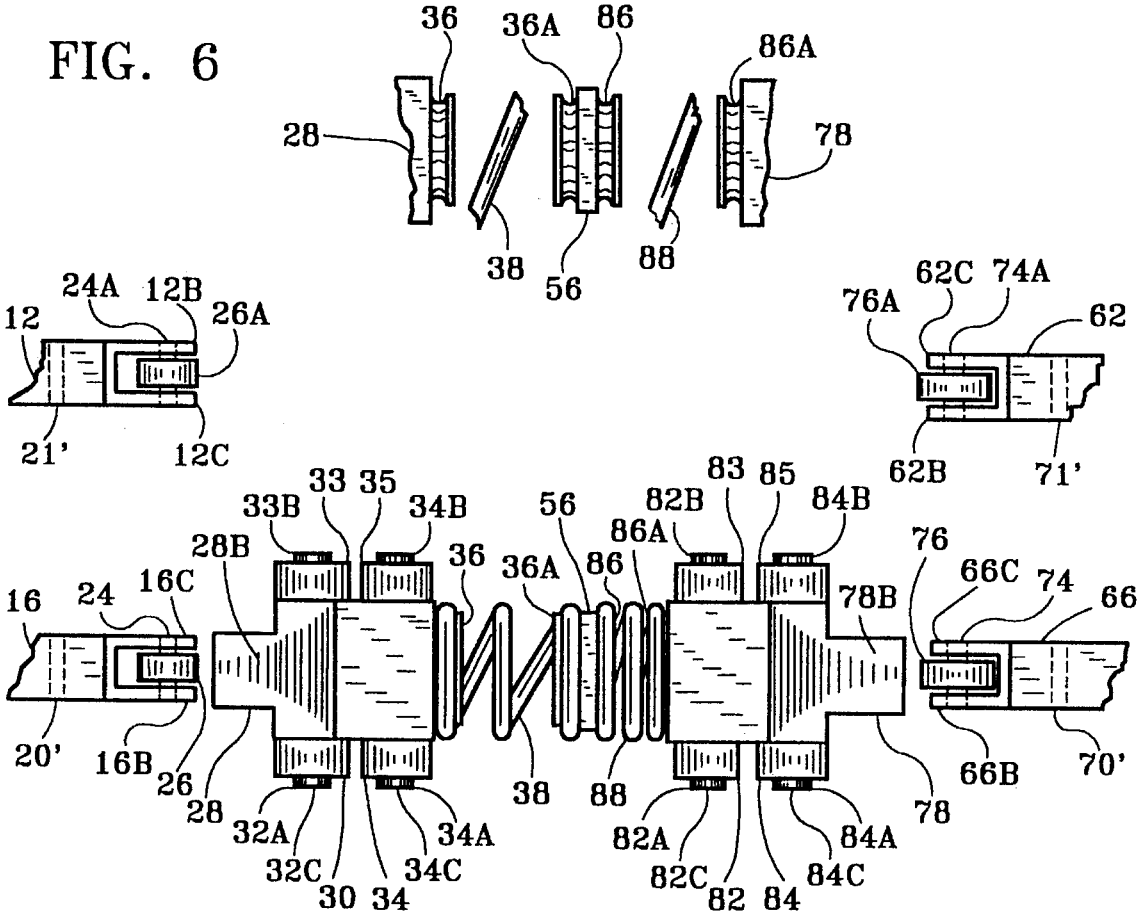
FIG. 6 Is an enlarged view showing the cam assemblies, blade roller assemblies and spring retaining grooves.

Referring with greater particularity to the drawings, the reference numeral 10 indicates generally a pair of mechanically operated handcuffs, embodying the principles of the invention. FIG. 1 shows a pair of prior art handcuffs 19 having a casing 17 for supporting a lock assembly, and a pair of spaced-apart arcuate cheek plates 15. Arcuate blade 13 is pivotally connected to the outer ends of the cheek plates 15. In operation, blade 13 is manually rotated to encircle the suspect's wrist and locks in casing 17. FIGS. 2, 3, 4 and 5 show a pair of mechanical operated handcuffs 10 that are comprised of a rectangular box-like casing 11 having a set of arcuate blades 12 and 16 mounted in the first end of casing 11. The first end of blade 16 has an expanded side wall 16A and forms chamber 18, which will receive the rounded end 12A of blade 12. As blade 12 closes it will encircle the wrist. A pinch guard 14 is mounted to an expanded side wall 16A of chamber 18 providing the prisoner pinch protection from the arcuate blade 12. At the opposite end from chamber 18, blade 16 has a pivot elbow 20 and through hole 20'. Blade 16 is pivotally mounted at through hole 20' onto support stud 20A. Support stud 20A is mounted permanently to casing 11E. Installed between the two flanges 16B and 16C of the second end of blade 16 is (as best shown in FIGS. 5 and 6) a blade roller 26 and blade roller axle 24 An opening spring 22 is mounted onto the extended circumference of support stud 20A. The first end of opening spring 22 pushes against casing side wall 11A and the second end of opening spring 22 pushes against the extended blade roller axle 24, urging the arcuate blade roller 26 and blade assembly 16 to rotate away from the casing side wall 11A. Blade 16 pivots on support stud 20A and automatically opens. The opening spring 22 asserts continuous pressure against blade roller axle 24 and transfers the pressure to blade roller 26. This pressure puts a load on cam assembly 28 and more specifically to the cam's concave surface 28A.

Respectively, at the first end of blade 12 is a rounded end 12A; having at the opposite end a pivot elbow 21 and through hole 21'. Blade 12 is pivotally mounted at through hole 21' onto support stud 21A. Support stud 21A is mounted permanently to casing 11E. Installed between the two flanges 12B and 12C of the second end of blade 12 (as best shown in FIGS. 5 and 6) is a blade roller 26A and blade roller axle 24A. An opening spring 22A is mounted on the extended circumference of support stud 21A. The first end of opening spring 22A pushes against casing side wall 11B as the second end of the opening spring 22A pushes against the extended blade roller axle 24A, urging the arcuate blade roller 26A and blade assembly 12 to rotate away from the casing side wall 11B. Blade 12 pivots on the support stud 21A and automatically opens. The opening spring 22A asserts continuous pressure against the blade's axle 24A and transfers the pressure to blade roller 26A. This pressure puts a load on cam assembly 28 and more specifically to the cam's concave surface 28B. In this configuration the telescoping handle 52 and cam assembly 28 are always in the open and ready-to-use position.

Figure 7:
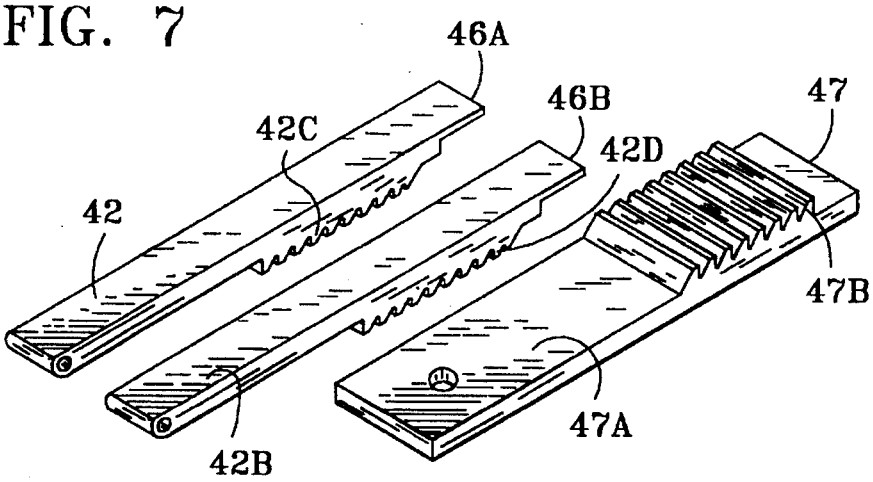
FIG. 7 Is a perspective view showing the left locking assembly.

FIGS. 5 and 6 best show cam assembly 28, which supports the forward axles 32A, 33B and aft axles 34A, 34B. Generally, axles are equally spaced on the horizontal center line of the cam assembly 28 and support cam roller bearings 30, 33, 34 and 35 Each axle 32A, 33B, 34A and 34B incorporates a through hole 32C and 34C to receive a common bolt and nut or other fastening means to secure a telescoping mounted handle 52 to cam assembly 28 A set of rectangular extruded flanges 40, 40', 40", 40" will support the top and bottom of cam roller bearings 30, 33, 34, 35 allowing the cam assembly 28 and telescope mounted handle 52 freedom of movement forward and aft along the horizontal axis of the rectangular extruded flanges 40, 40' in casing side wall 11E, and 40", 40'" in casing side wall 11F. The first end of tension spring 38 is mounted in the spring retaining groove 36 of cam assembly 28; the second end of the tension spring 38 is mounted to the spring retaining groove 36A. Groove 36A is machined into and making in part the center of brace 56. Tension spring 38 pulls the cam 28 and telescoping handle 52 toward the center brace 56. As the cam 28 and cam's concave surfaces 28A, 28B move away from the closed position in casing 11, will allow the blade rollers 26, 26A and axles 24, 24A (being urged by the opening springs 22 and 22A) to automatically rotate the arcuate blades 12, 16 to the open and ready-to-use position. Cam assembly 28 supports a straight double locking ratchet, best shown in FIG. 7. The ratchet plate 47 supports a straight surface area 47A and teeth 47B and is mounted to the cam assembly by screw 58, or other means, at the opposite side from the cam roller bearing's 34 and 35 centerlines. The pivotally mounted ratchet bars 42, 42B and supporting teeth 42C, 42D are installed onto a ratchet support stud 42A. Ratchet support stud 42A is mounted permanently to casing 11E. This adds the double locking feature to the ratchet cam plate 47. The pivotally mounted ratchet bars 42, 42B incorporate a ratchet bar spring 44 and spring retaining housing 44A and are mounted permanently by rivet or other means to casing 11E. Ratchet bar spring 44 will urge the pivotally mounted ratchet bars 42, 42B to pivot as the supporting teeth 42C, 42D slide over the cam ratchet plate teeth 47B, locking the teeth to cam plate 47 and making it an automatic locking device. A ratchet bar guard plate 46 is mounted in front of the pivotally mounted ratchet bars 42 and 42B. This guard plate prevents unauthorized lifting of the key pads 46A and 46B through key recess 48, made into the casing surface 11E, in which the officer would insert a key into the key recess 48 and unlock the ratchet cam plate 47.

FIGS. 2, 3, 4 and 5 show a mirror image of the mechanically operated handcuffs 10 which are comprised of a rectangular casing 11 having a set of arcuate blades 62 and 66 mounted in the second end of casing 11. The first end of blade 66 has an expanded side wall 66A and forms a chamber 68 which will receive the rounded end 62A of blade 62. As blade 62 closes it will encircle the wrist. A pinch guard 64 is mounted to an expanded side wall 66A of chamber 68, providing the prisoner pinch protection from the arcuate blade 62A. At the opposite end from chamber 68, blade 66 has a pivot elbow 70 and through hole 70'. Blade 66 is pivotally mounted at through hole 70' onto support stud 70A. Support stud 70A is mounted permanently to casing 11E. Installed between the two flanges 66B and 66C of the second end of blade 66 (best shown in FIG'S. 5 and 6) is a blade roller 76 and blade roller axle 74. An opening spring 72 is mounted onto the extended circumference of support stud 70A. The first end of opening spring 72 pushes against the casing side wall 11D and the second end of opening spring 72 pushes against the extended blade roller axle 74, urging arcuate blade roller 76 and blade assembly 66 to rotate away from the casing side wall 11D. Blade 66 pivots on support stud 70A and automatically opens. The opening spring 72 asserts continuous pressure against the blade roller axle 74 and transfers the pressure to blade roller 76, putting a load on cam assembly 78 and more specifically to the cam's concave surface 78A.

Respectively, at the first end of blade 62 is a rounded end 62A; at the opposite end is a pivot elbow 71 and through hole 71'. Blade 62 is pivotally mounted at through hole 71' onto support stud 71A. Support stud 71A is mounted permanently to casing 11E. Installed between two flanges 62B and 62C of the second end of blade 62 (as best shown in FIGS. 5 and 6) is a blade roller 76A and blade roller axle 74A. An opening spring 72A is mounted on the extended circumference of support stud 71A. The first end of opening spring 72A pushes against the casing side wall 11C and the second end pushes against the extended blade roller axle 74A, urging the arcuate blade roller 76A and blade assembly 62 to rotate away from the casing side wall 11C. Blade 62 pivots on support stud 71A and automatically opens. The opening spring 72A asserts continuous pressure against the blade's axle 74A and transfers the pressure to the cam roller 76A. This pressure puts a load on cam assembly 78 and more specifically to the cam's concave surface 78B. In this configuration the telescoping handle 102 and cam assemblies 78 are always in the open and ready-to-use position.

FIGS. 5 and 6 best show cam assembly 78, supporting a set of forward axles 82A, 82B and aft axles 84A, 84B. Generally, axles are equally spaced on the horizontal center line of cam assembly 78 and support cam roller bearings 82, 83, 84 and 85. Each axle 82A, 82B, 84A and 84B incorporates a through hole 82C and 84C to receive a common bolt and nut or other fastening means to secure the telescoping mounted handle 102 to cam assembly 78 A set of rectangular extruded flanges 40, 40', 40", 40'" will support the top and bottom surfaces of the cam roller bearings 82, 83, 84, and 85, allowing the cam assembly 78 and telescope mounted handle 102 freedom of movement forward and aft along the horizontal axis of the rectangular extruded flanges 40, 40' in casing side wall 11E and 40", 40'" in casing side wall 11F.

Figure 9:
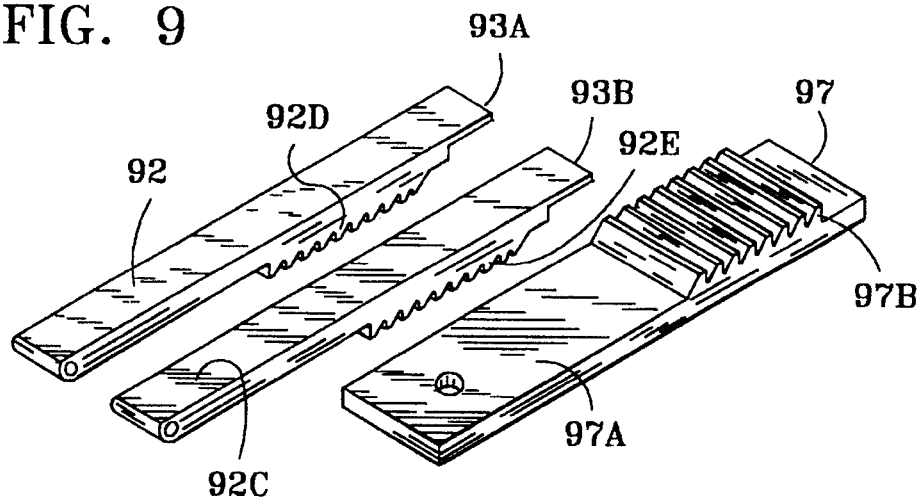
FIG. 9 Is a perspective view showing the right locking assembly.

The first end of tension spring 88 is mounted in the spring retaining groove 86A of cam assembly 78, the second end is mounted in spring retaining groove 86. Groove 86 is machined into and making in part the center brace 56. Tension spring 88 pulls the cam 78 and telescoping handle 102 toward the center brace 56. As the cam 78 and cam's concave surfaces 78A, 78B moves away from the closed position in the casing, will allow the blade roller axle 74, 74A (being urged by the opening spring 72, 72A) to automatically rotate the arcuate blades 62, 66 to the open and ready-to-use position. Cam assembly 78 supports a straight double locking ratchet, best shown in FIG. 9. The cam ratchet plate 97 supports a straight surface area 97A and teeth 97B and mounts to the cam assembly by screw 104 or other means at the opposite side from the cam bearing's 82 and 83 centerline. The pivotally mounted ratchet bar 92, 92C and supporting teeth 92D, 92E are installed on a ratchet support stud 92A. Ratchet support stud 92A is mounted permanently to casing 11E. This adds the double locking feature to the ratchet cam plate 97. Ratchet cam plate 97 incorporates a ratchet bar spring 94 and spring retainer housing 94A and is mounted permanently by rivet or other means to casing 11E. Ratchet bar spring 94 will urge the pivotally mounted ratchet bars 92, 92C to pivot as the supporting teeth 92D, 92E slide over the cam plate 97B locking teeth to cam plate 97, making it an automatic locking device. A ratchet bar guard plate 96 is mounted in front of the pivotally mounted ratchet bars 92 and 92C to help in preventing unauthorized lifting of the key pad 93A and 93B through key recess 98, made into casing surface 11E in which the officer would insert a key into key recess 98 and unlock the ratchet cam plate 97. The rectangular box like casing has extended first and second ends forming the engagement bumpers 50 and 100.

Each engagement bumper 50 and 100 are covered with neoprene material 50', 100' and will protect the suspect. The rectangular box-like casing sides 11E and 11F are assembled by fastening means 49.

Figure 8:
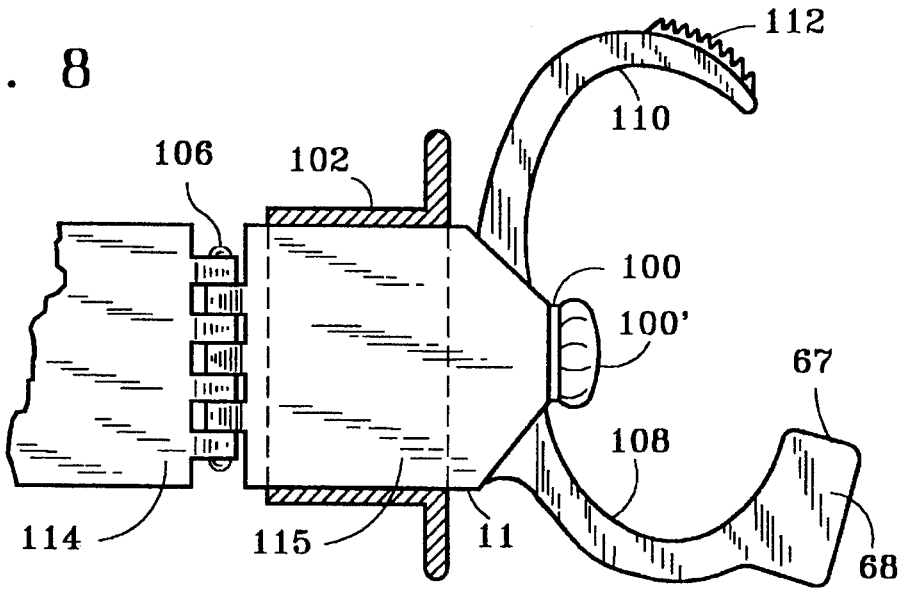
FIG. 8 Is a perspective view showing one stationary blade, one pivotal arcuate blade and a piano type hinge.

FIG. 8 shows additional embodiments of the present invention, in which the arcuate blade 108 is shown as a stationary blade forming part of casing 11 and having a conventional locking device 67 that forms part of chamber 68. The arcuate blade 110 is shown having a pivotal arcuate blade with a set of conventional teeth 112 on the outer edge to interact with an opposing set of teeth on a biased pivoting pawl member, which is part of the conventional lock assembly 67, installed in chamber 68. The second handcuff 114 is a mirror image of handcuff 115. The rigid casing as shown in FIG. 8 also incorporates a conventional piano type hinge 106 installed between first and second wristlets, which gives the handcuffs a flexible configuration and a folding capability.

OPERATION OF THE PRESENT INVENTION

In operation, the officer will remove the mechanically operated handcuffs from their holder; as the handcuffs 10 clear the holder, the arcuate blades 12, 16, 62 and 66 automatically open to the ready-to-use position by means of the opening springs 22, 22A, 72 and 72A. The tension springs 38, 88 retract the cams 28, 78 and telescoping handles 52, 102 toward the center brace 56, giving sufficient clearance for the arcuate blades 12, 16, 62, 66 to automatically pivot and rotate open past the cam surfaces 28A, 28B, 78A and 78B area. If one or more blades 12, 16, 62, 66 are inadvertently closed, the blades will automatically reopen to the ready-to-use position by the opening springs 22, 22A, 72, 72A. As the officer subdues the suspect he will have a firm grip on the telescoping handles and will place one of the two handcuff bumpers 50 or 100 against the suspect's limb. With sufficient pressure against the limb the officer will overcome the tension spring of either 38 or 88 forcing the telescoping handle 52 or 102 and cam assembly 28 or 78 to move forward along the rectangular extruded flanges 40, 40', 40", 40'" toward the suspect's limb. This forward movement of the cam assembly 28, 78 and cam's surfaces 28A, 28B or 78A, 78B will communicate with the blade's rollers 26, 26A or 76, 76A urging them to rotate and follow the cam's concave surfaces 28A, 28B or 78A, 78B, causing the blades 12, 16 or 62, 66 to pivot on support studs 20A, 21A, or 70A, 71A and close to encircle the suspect's limb. When the blades 12, 16, 62, 66 are sufficiently closed, and ensure a complete encirclement of the limb, the ratchet cam plates'47, 97 flat surfaces 47A, 97A will have slid under the pivotally mounted ratchet bars 42, 42B, 92, 92C allowing the pivotally mounted ratchet bar springs 44, 94 to urge the ratchet bars 42, 42B, 92, 92C down, making pivotal contact with ratchet bar teeth 42C, 42D, 92D, 92E and cam plate teeth 47B, 97B. This provides the arcuate blades 12, 16, 62, 66 with a double locking ratchet device. To unlock the mechanically operated handcuffs, the officer would insert a key into key opening 48 or 98 and rotate the key so the key flanges communicate with the pivotally mounted ratchet bar flanges 46A, 46B, 93A, 93B lifting the ratchet bar teeth 42C, 42D, 92D, 92E away from ratchet cam plate teeth 47B, 97B and unlocking cam 28 or 78 Tension springs 38 and 88 will automatically pull cams 28, 78 and the telescoping handles 52, 102 toward the center brace 56, pulling the cam's concave surfaces 28A, 28B and 78A, 78B away from the cam rollers 26, 26A, 76 and 76A. This allows the arcuate blades 12, 16, 62 and 66 to pivot freely on support studs 20A, 21A, 70A, 71A, allowing the arcuate blades 12, 16, 62, 66 to be automatically opened by the opening springs 22, 22A, 72 and 72A, thus releasing the limb of the suspect. The opposite end of the handcuff will operate in the same manner as previously described. FIG. 8 shows the stationary configuration of the secondary arcuate blade 108, which provides a third conventional type locking device forming in part the chamber 68 to receive the conventional arcuate ratchet blade 112. The stationary blade 108 will unlock and release the conventional arcuate ratchet blade 112 that would also automatically rotate open by means of the open springs 22A and 72A.

The handcuffs 10 of the present invention can be constructed using a metal injection molding process or by using drop forging. To reduce the weight of the handcuffs, however, preferably a lighter material would be used such as ZYTEL TM ST 801 made by E. I. DUPONT DENEMOURS ZYTEL TM ST 801 is a glass-filled (stiffened) super-tough nylon material. Another alternative is a glass-filled polycarbonate or lightweight polymericarbonate or another lightweight material that can be used as the molding material. For added lubrication and to prevent wear a TEFLON TM additive of a presently known composition can be used in the molding material of the moveable lock components. A preferred material for the bumpers 50', 100' is closed-cell, self-skinned neoprene generally available in sheet form under the trade name RUB ATEX TM, made by RUBATEX CORPORATION. Some of the components, such as the springs 22, 22A, 72, 72A, 38, 88 and common bolts, nuts and rivets are preferably formed of metal.

SUMMARY, RAMIFICATIONS AND SCOPE

Accordingly, the reader will see the mechanically operated handcuffs will offer better operating features than the previously described U.S. Patented handcuffs. Also the mechanically operated handcuffs have a ready-to-use feature that affords the officer an automatic device for opening the handcuff blades for quick use in capturing suspects. One forward movement of the telescoping handles and casing bumper against the suspect's limb will mechanically operate the handcuffs in a fast and efficient manner, rotating the blades around the suspect's limb or limbs. Furthermore, the mechanically operated handcuffs have the additional advantage in that they permit multiple automatic locking features and incorporate a set of handcuffs with a single rectangular box-like casing to help control and restrict the suspect's motions. They also provide handcuffs with a rigid blade forming part of the casing and incorporate a third locking means.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those skilled in the art.

We claim:

1. A set of handcuffs that are mechanically operated to encircle limbs of a suspect, comprising:

a.) a single, centrally positioned, generally rectangular box-like casing, b.) a pair of arcuate blades pivotally mounted in each opposite end of said casing, c.) a handle at each said end of said casing which telescopically slides over said casing, d.) a cam assembly inside said casing at each end thereof, each cam assembly connected to a handle and slidable therewith, to cam an end of two arcuate blades to close the blades around a limb of a suspect, and e.) a locking means at each end of said casing to prevent the opening of the blades.

2. The handcuffs as defined in claim 1, further including a neoprene bumper at each end of said casing.

3. The handcuffs as defined in claim 1, further including spring means at each end of said casing.

4. The handcuffs as defined in claim 1, further including flanges and a roller located on an end of said blades.

5. The handcuffs as defined in claim 1, wherein said locking means include key-actuated ratchet locks.

6. The handcuffs as defined in claim 1, further including rollers mounted on said cam assemblies.

7. The handcuffs as defined in claim 1, further including rounded ends on at least some of said arcuate blades.

8. The handcuffs as defined in claim 1, further including expanded side walls on ends of at least some of said arcuate blades.

* * * * *